US010378808B2

(12) United States Patent
Fassett et al.

(10) Patent No.: US 10,378,808 B2
(45) Date of Patent: Aug. 13, 2019

(54) ICE BIN LEVEL SENSOR

(71) Applicant: MARQUARDT MECHATRONIK GMBH, Rietheim-Weilheim (DE)

(72) Inventors: David J. Fassett, Cazenovia, NY (US); Tony Zhang, Cazenovia, NY (US)

(73) Assignee: Marquardt GmbH, Rietheim-Weilheim (DE)

( * ) Notice: Subject to any disclaimer, the term of this patent is extended or adjusted under 35 U.S.C. 154(b) by 508 days.

(21) Appl. No.: 14/830,049

(22) Filed: Aug. 19, 2015

(65) Prior Publication Data

US 2016/0313045 A1 Oct. 27, 2016

Related U.S. Application Data

(60) Provisional application No. 62/151,036, filed on Apr. 22, 2015.

(51) Int. Cl.
*F25C 5/187* (2018.01)
*F25D 29/00* (2006.01)

(52) U.S. Cl.
CPC ..... *F25C 5/187* (2013.01); *F25D 29/005* (2013.01)

(58) Field of Classification Search
CPC ..... F25C 2700/02; F25C 5/187
See application file for complete search history.

(56) References Cited

U.S. PATENT DOCUMENTS 3,360,951 A * 1/1968 Hoenisch ..... F25C 5/187 137/392
4,002,996 A * 1/1977 Klebanoff ..... A61M 5/1684 137/392
5,345,782 A 9/1994 Takahashi et al.
5,460,007 A 10/1995 Reed et al.
6,324,855 B1 12/2001 Mullis
6,414,301 B1 7/2002 Borg, Jr. et al.
2001/0027654 A1 10/2001 Shapiro et al.
(Continued)

FOREIGN PATENT DOCUMENTS

WO 01/27544 A2 4/2001

OTHER PUBLICATIONS

Cypress Perform, Capacitive Sensing Made Easy Part 1: An Introduction to Different Capacitive Sensing Technologies, By Pushek Madaan and Priyadeep Kaur, 8 pp, Apr. 2012.*
(Continued)

*Primary Examiner* — Cassey D Bauer
(74) *Attorney, Agent, or Firm* — Burr & Brown, PLLC

(57) ABSTRACT

An ice level sensor in an appliance that includes an ice storage housing and an ice maker. The housing receives ice from the ice maker. The ice level sensor includes a control circuit and one or more electrode arrays capable of detecting ice in the housing. The electrode arrays each contain one or more sense electrodes, and the control circuit detects ice in the housing based on a measurement of capacitance of the sense electrode(s). When the sensor detects that ice in the housing has reached a threshold level, the sensor can stop the ice maker from depositing more ice into the housing, to prevent overflow. The ice level sensor detects that ice has reached a threshold level by detecting changes in capacitance of a sense electrode or by detecting that the capacitance of a sense electrode reached a predetermined value.

20 Claims, 11 Drawing Sheets

(56) References Cited

U.S. PATENT DOCUMENTS

| | | | | |
|---|---|---|---|---|
| 2006/0201170 | A1 | 9/2006 | Cole | |
| 2009/0211292 | A1 | 8/2009 | Smith et al. | |
| 2012/0168458 | A1 | 7/2012 | Richmond et al. | |
| 2012/0251147 | A1* | 10/2012 | Gomi ..... | G03G 15/0189 399/58 |

OTHER PUBLICATIONS

Cypress Perform, "Proximity Sensing with CapSense®" Document No. 001-92239 Rev. (7 pages).

* cited by examiner

ICE BIN LEVEL SENSOR

FIELD OF THE INVENTION

The present invention is directed to a level sensor based on projected proximity capacitive sensing. The present invention is also directed to an ice level sensor for determining a level of ice in an ice storage housing. Information about the level of ice is needed to determine when an ice maker should be activated, to fill the ice storage housing to a threshold level, or deactivated, to prevent overfill. The present invention is further directed to detecting a level of a medium in a storage bin in which the medium is stored.

BACKGROUND OF THE INVENTION

Many appliances contain an automatic ice maker that deposits ice into a storage bin. The function of an ice maker is well-known in the art, so a detailed description thereof is not provided herein. An ice maker is activated to produce ice and deposit the produced ice into a storage bin. As long as an ice level sensor determines that the storage bin is not filled to a threshold (i.e., full) level, the ice maker continues to deposit ice into the storage bin. The ice maker is deactivated when the ice level sensor determines that the storage bin is full. In this way, the ice level sensor provides an interlock to avoid overfilling of the storage bin.

One common ice level sensor is in the form of a mechanical arm or bail. The normal resting position for the bail is in the space where ice will accumulate when the storage bin is full. When the bail is pushed upward by ice or prevented from being moved downward to the normal resting position, due to the ice level reaching or exceeding the full level, an indication will be provided to the ice maker to deactivate the ice maker. Mechanical sensors of this type frequently suffer from failure due to normal wear and tear of moving parts and damage resulting from food items being placed in the ice storage area or from removal and replacement of a removable ice storage bin. Mechanical arms are also prone to freezing in a non-interlock position while the ice maker continues to operate.

During the ice making process, ice cubes can become partially melted and then refreeze, being frozen to adjacent ice cubes. This may occur when an ice cube tray is heated slightly to allow cubes to be easily removed from the tray in the ice maker, and can also occur due to the warming cycles in a frost-free freezer. The top layer of ice cubes in the storage bin may be frozen together, forming a rigid layer that does not collapse even when ice beneath the rigid layer is removed from below. This condition is referred to herein as ice bridging. Ice level sensors that detect the presence of ice at the top of the storage bin, such as the mechanical bail, provide a false full indication when ice bridging occurs because the sensor continues to detect the presence of the top layer even though the ice bin is otherwise empty. Ice cubes sticking together can also prevent even lateral distribution of ice within the storage bin. In such situations, ice may be present at the resting position of the ice level sensor bail even though the storage bin is not otherwise full. This can occur, for example, when ice is removed from only one end of a storage bin or when new ice deposited into the storage bin is not evenly distributed.

Other technologies used for detecting the level of ice in a storage bin include ultrasonic sensors, temperature compensated infrared sensors, load cells, optical sensors and capacitive detection sensors. Ultrasonic, optical and temperature compensated infrared sensors are non-contact sensors (i.e., require no physical contact with the ice) that use transmitters and receivers to detect whether the storage bin is full, but they are generally designed to detect the ice level at only one position in or above the storage bin, which can lead to a false full indication during ice bridging or unevenly distributed ice conditions. In addition, fogging and/or frosting of the transmitters, receivers and/or light path, can interfere with operation of light based sensors.

Improper operation of mechanical and non-contact sensors alike can be caused by frost build-up around the sensor, such as by freezing of level contacts or interfering with suspension of a storage bin where a load cell is used. One method for dealing with this problem is the addition of heaters around the sensor parts, but heaters increase the cost of the system and use more power. Other solutions can be significantly more expensive. Load cell sensors and ultrasound sensors both suffer from unbalanced loading of ice within the bin.

Increasing the level of accuracy of an ice level sensor is accomplished by detecting the level or presence of ice at more than one location in the storage bin. However, duplication of parts, such as bails, transmitters and receivers and control circuitry increase the cost of the system.

Capacitive sensing technology is based on detecting changes in the capacitance of an electrode in a circuit. The capacitance measured on an electrode depends on the dielectric constant of the space around the electrode through which an electric field passes. Projected proximity capacitive sensing allows the electrodes to be at a distance from the medium to be detected. Since there is a difference between the dielectric constants of air and ice, capacitive sensing technology can detect differences in the amounts of ice and air within a distance of the electrodes. However, the accuracy of such detection can be affected by frost that builds up on the electrode(s) or on the walls of an ice storage bin within a detection space of the electrode.

Reed et al. (U.S. Pat. No. 5,460,007) discloses an ice level sensor that relies on capacitive sensing. Specifically, the sensor disclosed by Reed et al. uses an analog controller based on a Wheatstone bridge to detect a difference between a first measured capacitance and a second measured capacitance. The first measured capacitance is the capacitance measured between a first electrode and a second electrode (ground electrode) positioned adjacent to the top of an ice storage bin. The first measured capacitance changes if there is ice in the detection space of the first electrode. The second measured capacitance is the capacitance measured between a third electrode and the second electrode (ground electrode). The third electrode is positioned above the ice storage bin. The second measured capacitance is based on the dielectric constant of the space above the ice storage bin, which is an air space. Reed et al. compares the measured capacitance of the first electrode to the measured capacitance of the third electrode to determine whether the portion of the ice storage bin contains ice or air. This detection device is limited to a single point of detection in the portion of the ice storage bin that is near the first electrode. Due to the configuration of a Wheatstone bridge, the number of electrodes that can be monitored by a controller of this type is fixed. In addition, the detection accuracy of the analog controller depends on circuit balancing that may be difficult to recreate in a manufacturing environment and/or may require calibration, which adds to the manufacturing time and cost.

Therefore, what is needed is an ice level sensor that does not rely on moving mechanical parts, will not be affected by fogging, will not be expensive or difficult to manufacture, does not require calibration, will provide detailed information about the quantity of ice in a removable storage bin with a high degree of reliability and will dynamically adjust to frost build-up over time.

SUMMARY OF THE INVENTION

An appliance according to a first embodiment of the present invention comprises a housing configured to receive ice from an ice maker, the housing comprising at least one wall; and an ice level sensor comprising a control circuit and at least a first electrode array, the at least first electrode array comprising at least a first sense electrode, the ice level sensor configured to detect ice in the housing based on a measured capacitance of the first sense electrode. In one aspect of the first embodiment, the ice level sensor is configured to detect ice in the housing based on a comparison between a first measured capacitance of the first sense electrode and a second measured capacitance of the first sense electrode. In another aspect of the first embodiment, the ice level sensor is configured to detect ice in the housing based on a comparison of the measured capacitance of the first sense electrode to a predetermined value.

In another aspect of the first embodiment, the ice level sensor is configured to detect ice in the housing based on whether a change in the measured capacitance of the first sense electrode exceeds a predetermined value. In another aspect of the first embodiment, the ice level sensor further comprises a second electrode array, and the second electrode array comprises at least a second sense electrode. In another aspect of the first embodiment, the housing comprises a second wall, the ice level sensor further comprises a second electrode array, and the second electrode array is on the second wall of the housing.

In another aspect of the first embodiment, the ice level sensor comprises an electrical connection between the control circuit and the at least first sense electrode, the control circuit is configured to apply a first signal on the electrical connection to each of the at least first sense electrode and monitor the electrical connection to each of the at least first sense electrode, and the measured capacitance of the at least first sense electrode is determined based on the monitored electrical connection to the at least first sense electrode. In one aspect, the first signal may be periodically applied, and the control circuit may monitor the electrical connection to the at least first sense electrode when the signal is not applied. In another aspect, the control circuit may monitor the electrical connection by monitoring the voltage of the electrical connection.

In a further aspect of the present invention the first sense electrode is an elongated conductive element that is positioned such that the longest dimension of the first sense electrode is horizontal. In one aspect, the first electrode array further comprises a second sense electrode parallel to the first sense electrode, and a ground electrode positioned between the first and second sense electrodes parallel to the first and second sense electrodes. In another aspect, the housing further comprises at least a second wall and a third wall, and the first electrode array extends across the first wall, the second wall and the third wall of the housing. In at least one variation of the invention, the first electrode array further comprises at least a first shield electrode, the ice level sensor further comprises an electrical connection between the control circuit and the first shield electrode, and the control circuit is configured to apply a buffered version of the first signal on the electrical connection to the first shield electrode. The shield electrode may comprise at least a first area and a second area. The first area of the first shield electrode may surround the first sense electrode without electrically contacting the first sense electrode.

In another aspect of the invention, the first electrode array further comprises second and third sense electrodes, but is not limited thereto. Each of the first, second and third sense electrodes extend horizontally from at least a first vertical line for at least a first distance, the second sense electrode is positioned between the first sense electrode and the third sense electrode, with the first area of the first shield electrode further surrounding the second sense electrode and the third sense electrode and extending the first distance between the first electrode and the second electrode and the first distance between the second electrode and the third electrode, the first area of the first shield electrode electrically isolated from each of the first, second and third sense electrodes.

In another aspect, the housing comprises a second wall and a third wall, with the first electrode array extending across the first wall, the second wall and the third wall of the housing. Alternatively, the ice level sensor further comprises a second electrode array and a third electrode array, the second electrode array extending across the second wall of the housing, and the third electrode array extending across the third wall of the housing. In another aspect, the ice level sensor comprises a plurality of arrays, with arrays positioned on one or more of a front wall, a left side wall, a right side wall, a bottom and/or a back wall.

In another aspect of the invention, the first electrode array further comprises at least a guard electrode, the first guard electrode extending along a perimeter around the first area of the first shield electrode, and the control circuit configured to measure the capacitance of the guard electrode. In one aspect the control circuit may disable an indication of ice detection when a change of capacitance of the guard electrode is detected. In another aspect, the change of capacitance of the guard electrode is not caused by ice in the housing. In another aspect, the change of capacitance of the guard electrode exceeds a threshold. In another aspect of the present invention, the first shield electrode comprises a second area extending along a perimeter around the guard electrode, the second area of the first shield electrode is electrically connected to the first area of the first shield electrode.

In one aspect of the present invention, the control circuit does not monitor the electrical connection between the control circuit and the first shield electrode and/or the control circuit does not measure the capacitance of the first shield electrode. In another aspect of the present invention, the position of the first electrode array is one of on an outside surface of the first wall of the housing, on an inside surface of the first wall of the housing, and within the first wall of the housing.

In one variation of the present invention, the first array comprises a plurality of sense electrodes each having a first zig-zag shape, the first sense electrode extending horizontally from a first vertical line to a second vertical line, the other sense electrodes of the plurality of sense electrodes extending horizontally and parallel to one another from the first vertical line to the second vertical line at positions lower than the first sense electrode, the plurality of sense electrodes spaced apart and electrically isolated from each other, the first area of the first shield electrode extending around but not between the plurality of sense electrodes. A straight horizontal line may extend through portions of at least two of the plurality of electrodes.

In one aspect of the invention, at least one of the top of the housing and a side wall of the housing comprises a door to access the interior of the housing. In the present invention, the ice maker may be within the housing or outside the housing with a passage through the top or a wall of the housing allowing the ice maker to deposit ice into the housing. In any aspect of the present invention, the ice level sensor may provide an interlock to stop the ice maker from depositing ice into the housing. In one aspect of the invention, all electrodes of the ice level sensor are positioned horizontal to spaces in the housing configured to store ice but other positions are within the scope of the present invention. In another aspect, all electrodes having capacitance measured by the control circuit are positioned to change capacitance when ice is stored in the housing.

In a second embodiment, the invention comprises a level sensor configured to detect a level of a medium in a storage bin, comprising a control circuit and at least a first electrode array. The at least first electrode array comprises at least a first sense electrode, where the level sensor is configured to detect the medium in a housing by applying an electric potential to the first sense electrode, measuring a change in capacitance of the first sense electrode, and determining that the storage bin is filled to the level based on the measured change.

In a third embodiment, the invention comprises a method of detecting ice in a housing using an ice level sensor that comprises a control circuit and at least a first electrode array, the at least first electrode array comprises at least a first sense electrode, the method comprising positioning the first array on a wall of an ice storage housing, and detecting ice in the housing based on a measured capacitance of the first sense electrode.

Embodiments, aspects and variations of the present invention as described above may be combined and such combinations are within the scope of the present invention as disclosed herein.

DETAILED DESCRIPTION OF THE INVENTION

Figure 1:
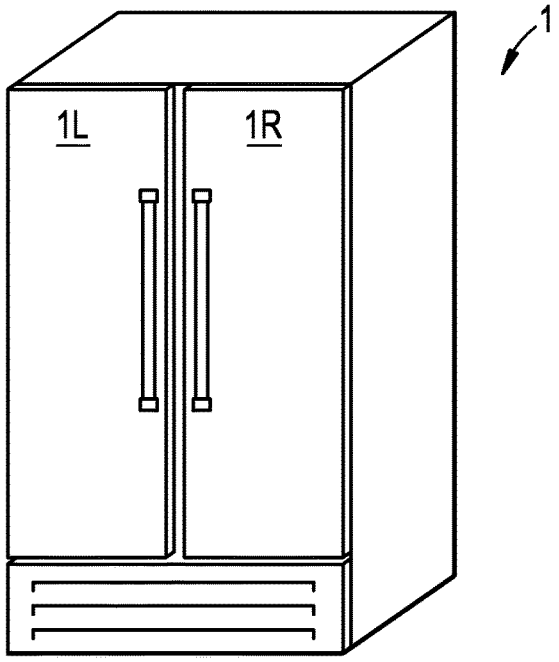
FIG. 1 is an appliance as one embodiment of the invention.

The previously discussed problems with existing ice level sensors are overcome by ice level sensors according to the present invention. Capacitive sensing according to the present invention can be used to reliably detect the quantity of ice in a storage bin, even under the conditions of ice bridging or uneven distribution. An ice level sensor according to some embodiments of the present invention can dynamically adjust to environmental conditions affecting the capacitance measurement, and can account for electrical interference of the signals provided to the control circuit, thereby eliminating the need for one or more heaters to remove the frost and shielding to reduce electrical interference. An ice level sensor according to the present invention may be configured to provide an increased level of accuracy, detail and/or reliability, may be easily produced and does not require the step of calibration that is required for existing analog controlled sensors.

In an appliance including an ice maker, such as a residential refrigerator, a housing for storing ice is also included. Ice may be stored in an ice storage bin within the housing, an ice storage bin may be fixed to or removable from the housing, and an ice storage bin may be integral with the housing. The storage bin may be accessed by opening a door, such as a freezer door on the front of a refrigerator. The ice may be dispensed by an automatic dispenser on a door or wall of an appliance. The ice may be dispensed through the bottom or a side wall of the storage bin, or may be removed from the top. The housing may be a drawer or may be contained in a drawer within an appliance. The ice level sensor of the present invention can be adapted to any of these configurations, and is not limited thereto.

The present invention utilizes a Cypress PSoC 4 from Cypress Semiconductor as the control circuit, but the present invention is not limited thereto. Embodiments of the present invention include various electrode configurations. Electrode configurations may be referred to herein as arrays of electrodes. A description of the operation of respective electrodes will be described in more detail below. A detailed explanation of the Cypress PSoC 4 is available in documentation from Cypress Semiconductor.

In an ice level sensor according to the present invention, ice is detected by the capacitance of a sense electrode. Since the dielectric constant of air is much different than the dielectric constant of ice, a control circuit can determine whether the space through which an electric field passes contains air or ice by measuring the capacitance of the electrode. The farther away ice is located from a sense electrode, the smaller the change in capacitance caused by the ice. The distance at which ice can be sensed using projected proximity capacitive detection depends on a variety of factors including the dimensions and shape of the sense electrode, parasitic capacitance caused by floating or grounded conductive objects near the sense electrode, the strength of the signal applied to the electrode by the control circuit, environmental electrical noise and other factors. The description of an ice level sensor presented herein also pertains to a level sensor for detecting the level of a medium in a storage bin.

The electric field can pass through nonconductive materials, such as plastic panels that form the walls of an ice storage bin and/or housing, with little or no impact on the measured capacitance. With an electrode positioned outside of a wall of an ice storage bin, an ice level sensor according to the present invention can determine whether ice is present in a space inside the storage bin even if the electrode is separated from the space by one or more nonconductive panels, as long as the electrode is positioned within a sensing distance of the sensor. By using multiple electrodes, the sensor can detect the presence of ice in multiple spaces in the ice storage bin. Based on signals from the respective electrodes, an accurate estimate of the total amount of ice in the ice storage bin can be reliably provided.

An ice level sensor according to the present invention may include one or more sense electrodes. The system may also include at least one ground electrode, at least one shield electrode and/or at least one guard electrode. The system may also comprise a slider array, which is an array of electrically isolated sense electrodes in a zig-zag pattern. The slider array may include at least one shield electrode and/or at least one guard electrode surrounding the pattern of sense electrodes.

In an ice level sensor according to embodiments of the invention, all the electrodes in an array of electrodes may be located substantially in the same plane, or may extend over a plurality of planar and/or non-planar surfaces. An ice level sensor according to the invention may comprise a plurality of arrays of electrodes that may all be in the same plane or may be in different planes positioned to detect ice in a storage bin or housing. One or more electrodes and/or arrays of electrodes may be positioned on a single wall of a storage bin or housing. One or more electrodes and/or arrays of electrodes may be positioned on any combination of front, back, left, right, bottom and/or top sides of an ice storage bin or housing.

As is known to a person of skill in the art, the capacitance of an electrode can be measured as an equivalent resistance. A signal is periodically applied to the electrode and the voltage level is periodically measured. To detect changes in capacitance, the measured voltage level is compared to a baseline. The baseline is determined by the parasitic capacitance and other factors known in the art. For example, the signals in the circuit can be affected by Gaussian and random electrical interference or noise. The baseline measurement can be adjusted to compensate for changes in parasitic capacitance and for electrical interference, as long as a minimum signal to noise ratio is maintained.

The parasitic capacitance of one or more electrodes can be reduced by implementing a shield electrode. A buffered version of the signal that is applied to the corresponding one or more sense electrodes is applied to a shield electrode. In embodiments of the present invention, a shield electrode may be placed between a sense electrode and floating or grounded conductive objects or materials. In other embodiments, a shield electrode may be located between respective sense electrodes in an array of electrodes. When an electrical trace to a sensor electrode is long, the parasitic capacitance of the sense electrode can be very high. Coupling of electric field lines from the trace to ground is accounted for by a shield electrode.

A guard electrode is used to account for situations when parasitic capacitance is so high that an acceptable signal to noise ratio cannot be maintained. Water is a conductive material that significantly increases the capacitance of an electrode. When running water comes into contact with a sense electrode, a capacitance much higher than parasitic capacitance is detected and the effect of a shield electrode can be masked. To account for this and similar situations, a guard electrode is positioned around the periphery of the sense electrode(s). A guard electrode operates like a sense electrode but is used to detect increases in capacitance that may be many times the capacitance increase that would be cause by ice in the housing. When the guard electrode detects such high capacitance, the control circuit prevents an indication that ice has been detected by a sense electrode.

A ground electrode may be placed between two sense electrodes that are in close proximity to each other to serve as a termination for their respective electric fields. By this method, the parasitic capacitance between the electrodes (i.e., cross-coupling capacitance) can be minimized, to allow independent detection measurements by sense electrodes that would interfere with each other without the presence of the ground electrode.

Because ice cubes in a storage bin tend to spread horizontally, filling all parts of the ice bin to approximately the same level, the electrodes used for detecting the level of ice in a storage bin in some embodiments of the invention are of an elongated shape and the electrodes are positioned with the elongated direction of the electrodes oriented horizontally. If a sense electrode is placed at a threshold level on a side of a storage bin or housing, the top level of ice in the bin would then be substantially parallel to the electrode. As the ice level rises, the top level of ice will reach a point at which it is close to the electrode over the entire length of the electrode, causing an increase in the measured electrode capacitance.

To increase the accuracy of the ice level sensor, some embodiments of the invention comprise additional sense electrodes to detect ice in a plurality of spaces within the storage bin. In this way, unevenly distributed ice can be accurately detected. In addition, by positioning a plurality of sense electrodes parallel to each other at different levels on a wall of a storage bin or housing, more detailed information about the ice contained in the bin can be obtained. For example, an ice level sensor having plural parallel sensors can determine that an ice bridging situation exists when ice is detected a higher level, but ice is not detected at a lower level.

In some embodiments, plural sense electrodes are positioned to simultaneously detect ice in the same part or level of the ice storage bin. In such embodiments, an indication of ice detection is provided with higher confidence because the sensor is tolerant to failure of an electrode. The plural measurements can be compared to each other and, if the measurements to not agree with each other, an error signal can be issued by the control circuit via a user or maintenance interface, or a voting scheme can be implemented to exclude the aberrant measurement. All of the above capabilities are within the scope of the present invention.

Embodiments of the invention are described in more detail with reference to the figures. Like numbered parts in each of the figures are understood to have the same or similar function whether depicted having the same or different form, unless stated otherwise.

In the embodiment shown in FIG. 1, a common appliance 1 (e.g., side-by-side refrigerator) comprises a left door 1L and a right door 1R. The appliance 1 depicted in FIG. 1 is one example of a household refrigerator/freezer in which the present invention may be implemented. Embodiments of the present invention include other models and/or types of residential refrigerators, freezers and other appliances, and also include commercial and/or industrial appliances or machines comprising a housing in which the level of ice stored therein is detected.

Figure 2:
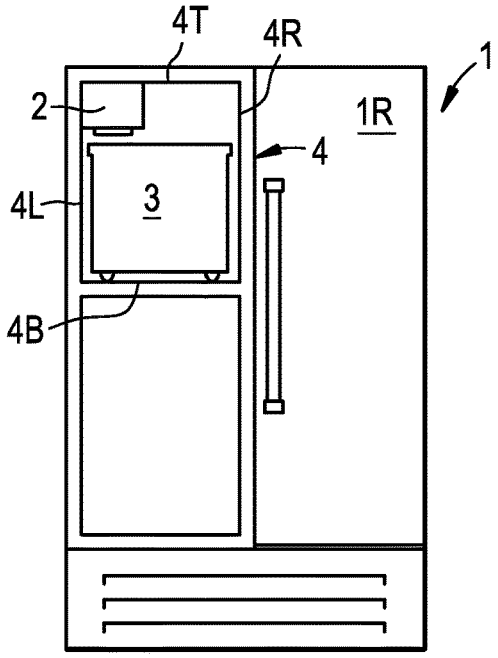
FIG. 2 is the appliance of FIG. 1 with the left door removed.

FIG. 2 shows the appliance 1 with the left door 1L removed to expose an exemplary configuration of a portion of the appliance comprising an ice maker 2 and a storage bin 3 within a housing 4. Housing 4 includes an internal space defined by left side wall 4L, right side wall 4R, bottom 4B, top 4T. The internal space is further defined by a back wall and front wall, which are not shown. The top, bottom or any sidewall of the housing may include or comprise a door. As is well-known in the art, the internal walls of a freezer housing 4 are typically comprised of nonconductive panels that may be some fraction of an inch in thickness. The walls of the housing 4 are typically separated from outside walls of the appliance or from walls of other interior spaces of the appliance 1 by spaces that may be empty or may contain insulation and/or wiring, electronics, plumbing, structural components and/or other parts. The storage bin 3 may be removable or not removable from the housing 4. Ice is produced by ice maker 2 and deposited into the storage bin 3 depending on an interlock provided by the ice level sensor.

Figure 3:
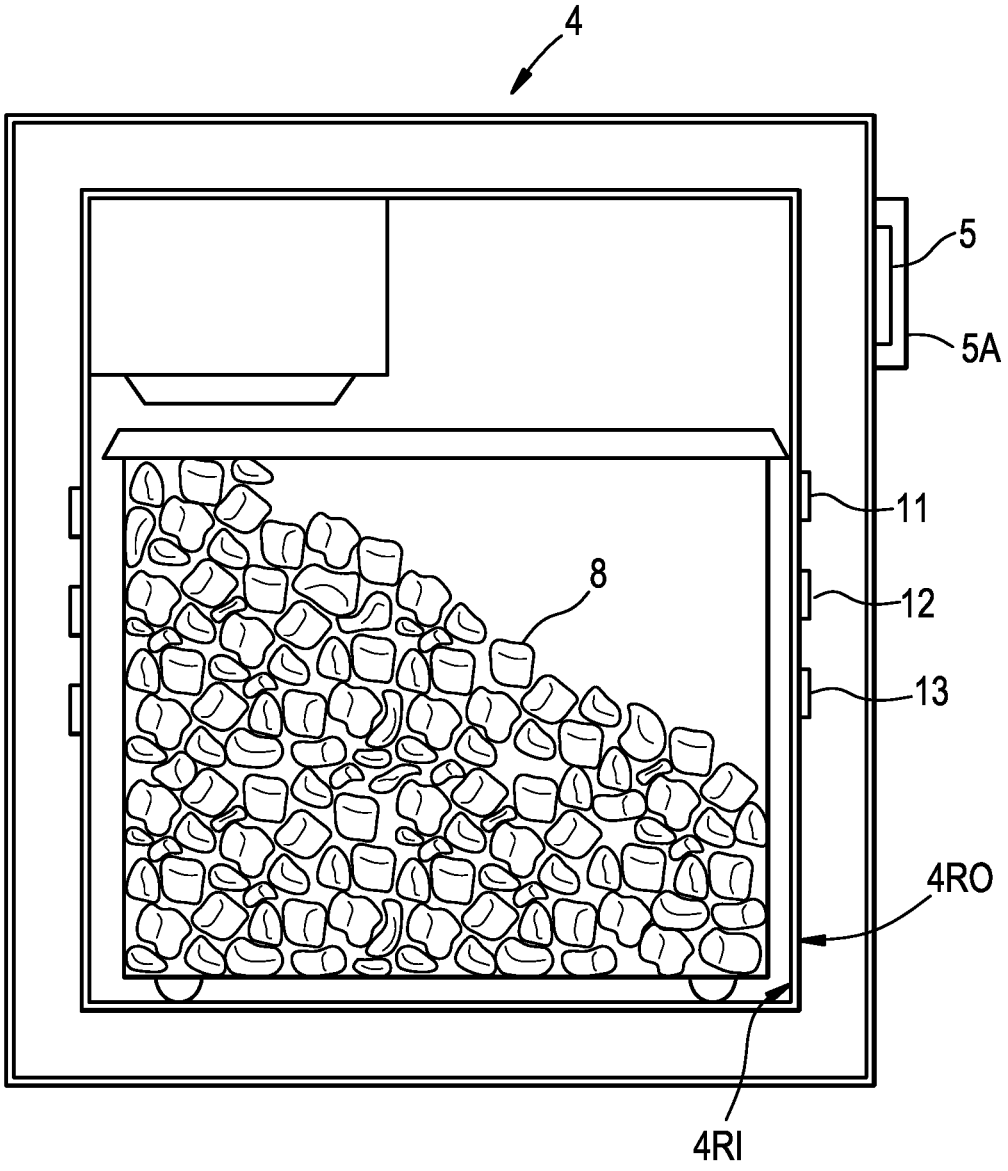
FIG. 3 is a front view of the upper left portion of the appliance of FIG. 2 with a first electrode configuration on the outside surface of the housing walls.

FIG. 3 shows a detached front view of the upper left portion of the appliance 1 in FIG. 2, including the housing 4, the ice maker 2 and the ice storage bin 3. The inside surface (4RI) and outside surface (4RO) of right side wall 4R are clearly identified for illustration purposes, but it is easily understood that each wall has an inside surface facing the internal volume of the housing, and each wall has an outside surface facing the space between the housing and either the outside wall of the refrigerator or a wall of another interior space within the appliance. The left side wall 4L and the top wall 4T of the housing are spaced from a left outside wall and a top outside wall of the appliance, respectively. The right side wall 4R and bottom wall 4B of the housing are spaced from walls that define other interior spaces of the appliance. The front wall (i.e., the removed left hand door 1L) and the back wall are not shown but each also has an inside surface and an outside surface spaced from a wall of the appliance. The spaces between housing walls and other interior walls of the appliance may contain insulation and/or wiring, electronics, plumbing, structural components and/or other parts.

In FIG. 3, a control circuit 5 is positioned within a control circuit housing 5A as shown on the upper right outside surface of the housing 4, but the control circuit may be located in any other part of the appliance, and/or the control circuit may comprise plural components that may be in the same or different parts of the appliance that communicate by wire or wirelessly. At least a portion of the control circuit must be electrically connected to the electrodes. The one or more components of the control circuit may each be inside or not inside respective housings. For example, the control circuit or parts thereof can be positioned on one or more of an inside surface or outside surface of a housing wall, a surface of another interior wall of the appliance, within a wall of the appliance, on a wall of the storage bin or outside the appliance.

In FIG. 3, electrodes 11, 12 and 13 are shown on the outside surface of housing walls 4L and 4R. Electrodes may be positioned on an outside surface of one or more housing walls, on an inside surface of one or more housing walls, and/or on an outside surface of a storage bin wall. Electrodes may also be positioned within the interior of a wall of the housing or storage bin. Electrodes interior to a wall may be integral to the wall panel, positioned in a cavity within the wall panel, or otherwise incorporated within a wall. Electrodes positioned on the outside surfaces of walls of a housing, or positioned interior to one or more walls, are not subject to damage or wear from inside the housing 4. Electrodes located on the inside surfaces of the housing 4 or on an outside surface of the storage bin 3 may be damaged while the storage bin is removed from or returned to the housing, for example.

In the embodiment shown in FIG. 3, the ice maker 2 is within housing 4, but the ice maker 2 could be positioned outside the housing 4, such as above the top wall of the housing inside or outside the appliance, as long as ice from the ice maker 2 can be deposited into the storage bin 3. In FIG. 3, upper electrode 11, middle electrode 12 and lower electrode 13 are shown on the outside surface of the left housing side wall 4L, and on the outside surface of the right housing side wall 4R. Ice cubes 8 are shown in the storage bin 3 in an uneven distribution.

Figure 4:
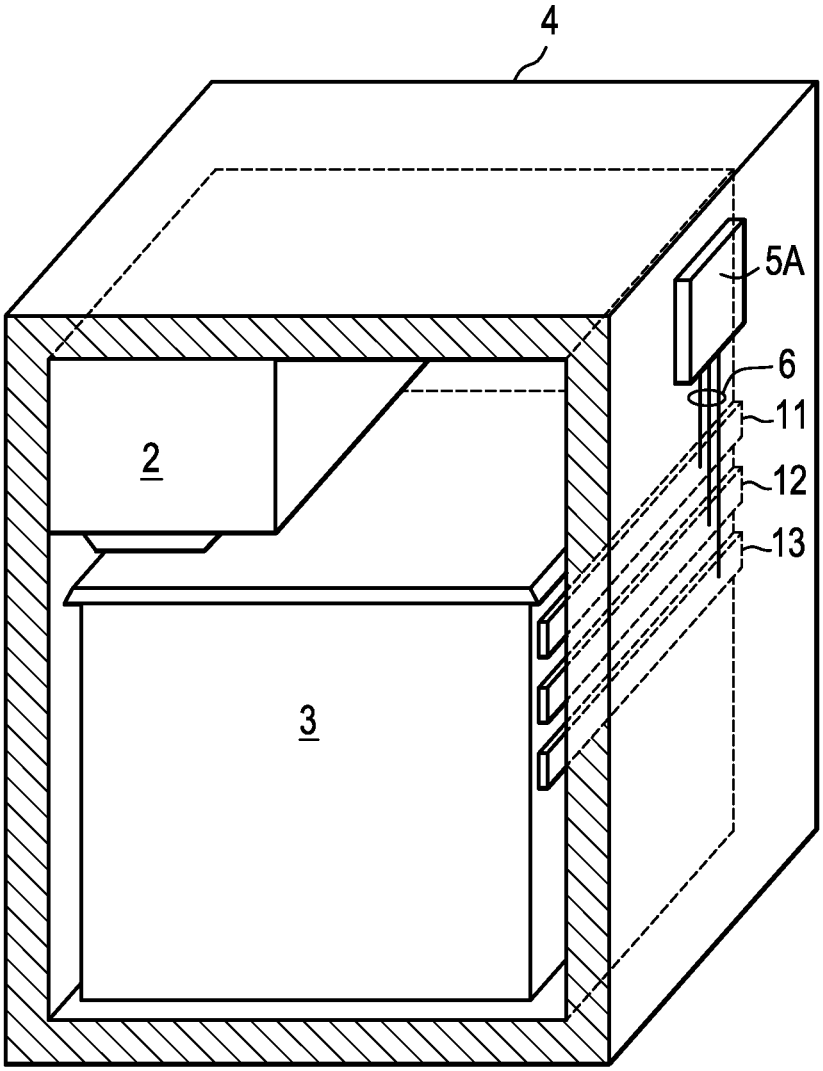
FIG. 4 is a perspective view of the portion of the appliance in FIG. 3.

FIG. 4 is a perspective view of the housing 4 of FIG. 3. Portions of electrodes 11-13 on the outside of housing wall 4R are shown. Also shown in FIG. 4 are electrical connections 6 from the control circuit 5 within the control circuit housing 5A to electrodes 11-13. Electrical connections 6 can be in the form of cables, wires, conductive tape, conductive traces, buses, coaxial cables and/or other conductors capable of electrically connecting electrodes to the control circuit. In order to minimize parasitic capacitance, it is preferable to minimize the overall lengths of the connections and to minimize the distance over which respective adjacent connections run parallel to one another.

Electrodes 11-13 are shown in each of FIGS. 3-7. In the configuration shown, upper electrode 11 and lower electrode 13 are sense electrodes, and electrode 12 can be either a shield electrode or an electrically grounded electrode. In the embodiments shown in FIGS. 3-7, lower electrode 13 will detect ice at a lower level in the bin while upper electrode 11 will detect ice at a higher level in the bin. When the bin is partially full, lower electrode 13 may detect ice while upper electrode 11 does not detect ice. When both electrodes 13 and 11 detect ice, the sensor determines that the storage bin is full. If upper sense electrode 11 detects ice but lower sense electrode 13 does not, the sensor would recognize an ice bridging situation as discussed above. When ice bridging is detected, a signal may be sent to a display or other interface to notify an operator of the condition. In some embodiments, the signal may be sent to a device that addresses the ice bridging situation.

Figure 5:
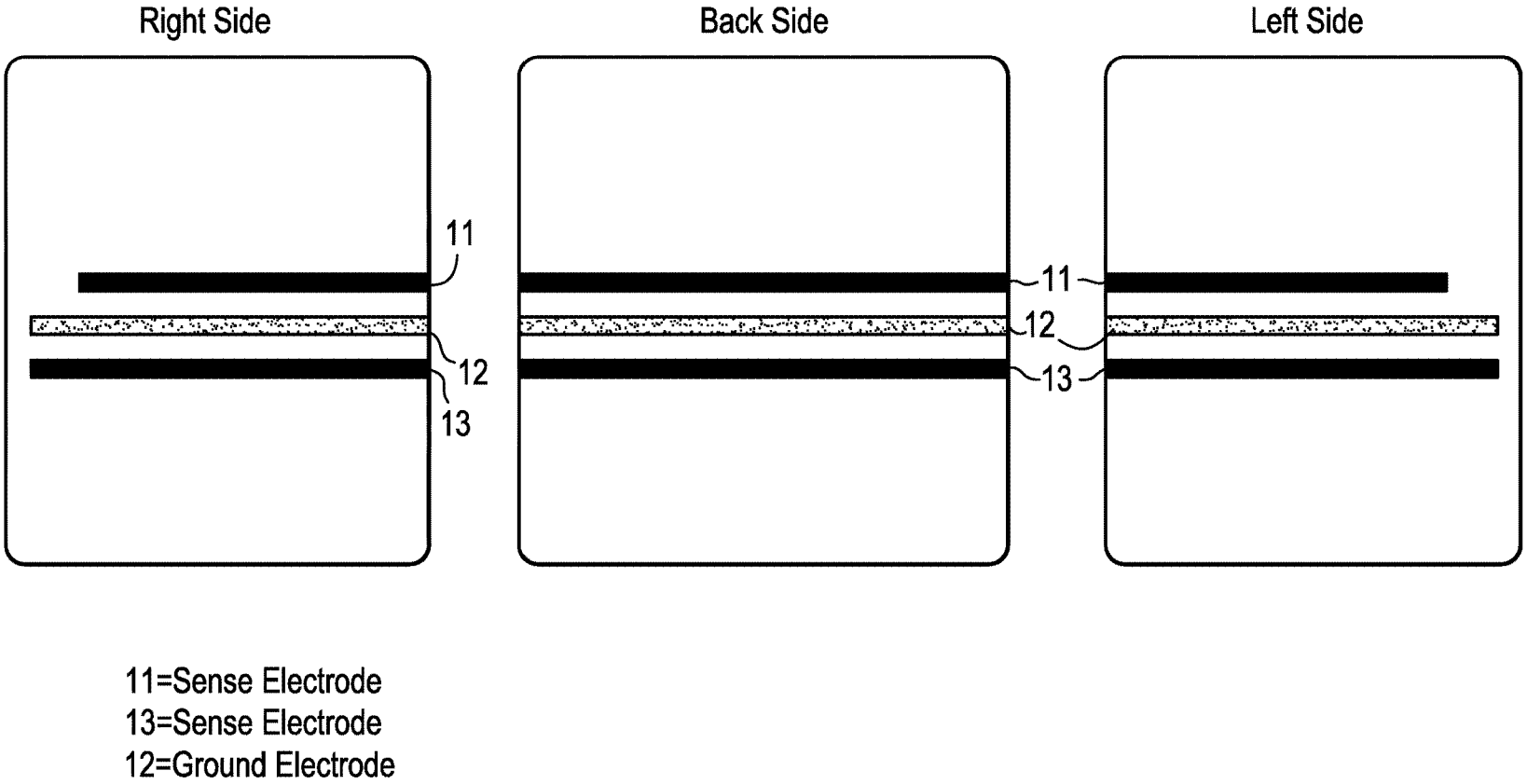
FIG. 5 is a flattened view of the outside surface of the walls of the housing in FIGS. 3 and 4 comprising the first electrode configuration.

In FIG. 5, which includes views of the left, back and right side walls of a housing 4 or storage bin 3, electrodes 11, 12 and 13 extend continuously around the left, back and right side walls, but the present invention is not limited to such configuration. In other electrode configurations, more or less sense electrodes can be used. For example, only one sense electrode may be used, with or without a shield electrode or a ground electrode. Alternatively, more sense electrodes may be used. In some configurations, a shield electrode may be provided between each sense electrode and an adjacent sense electrode, or between any two parallel or non-parallel sense electrodes that are in proximity to each other. The electrodes may extend continuously around one or more of the vertical walls of the housing and/or may be positioned on or extend to the bottom or top of the housing.

Figure 6:
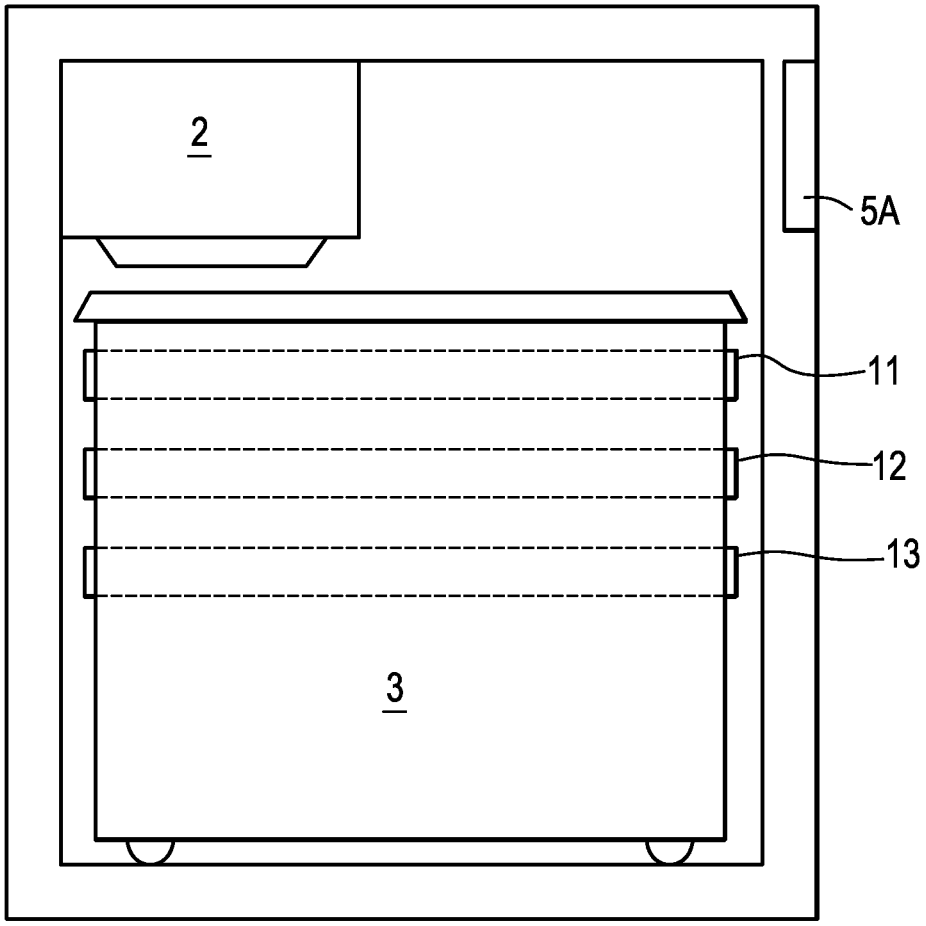
FIG. 6 is a front view of the upper left portion of the appliance in FIG. 2 with the first electrode configuration on the outside surface of the storage bin walls.
Figure 7:
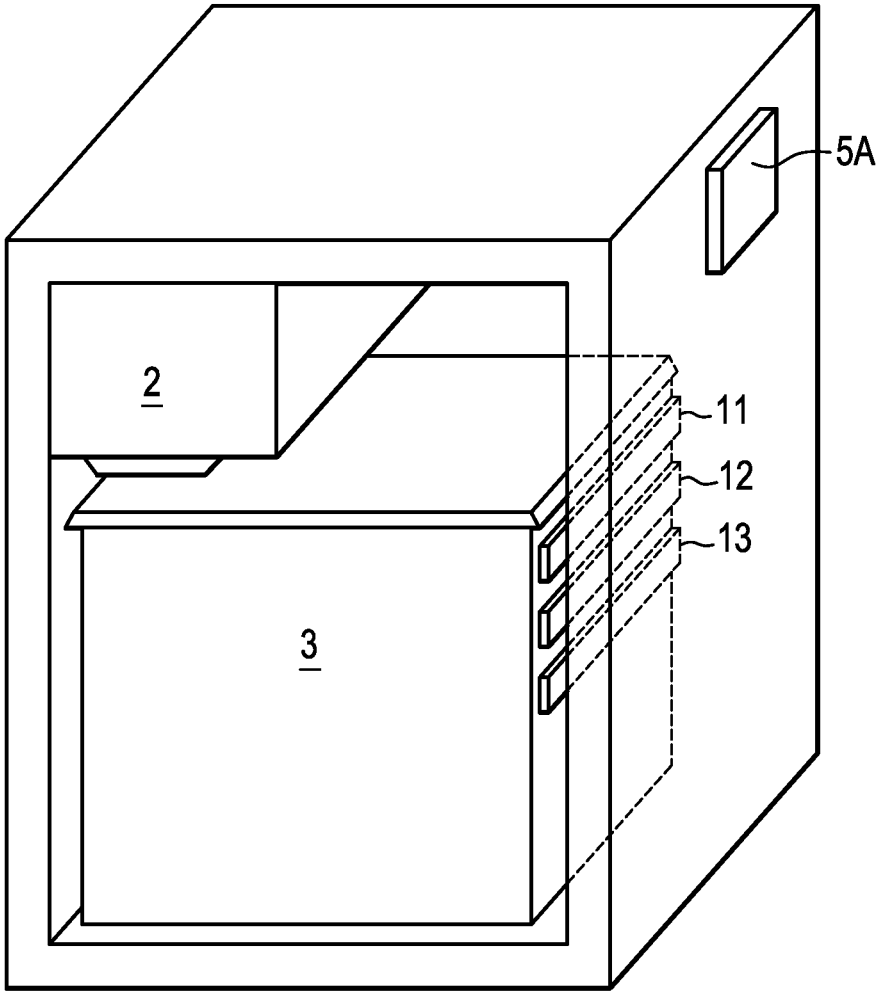
FIG. 7 is a perspective view of the portion of the appliance in FIG. 6.

FIG. 6 shows a front view of housing 4 with an array of electrodes having the configuration shown in FIG. 5 provided on the outside walls of the storage bin 3. In the embodiment in FIG. 6, the control circuit housing 5A is located in a space between the outer surface 4RO of the housing right wall and another wall of the appliance. The location of housing 5A is independent of the location of the electrode array(s). FIG. 7 shows a perspective view of housing 4 shown in FIG. 6. When electrodes are positioned on a storage bin 3 that is removable from the housing 4, a means for providing power and/or communication signals to the electrodes and/or any part of the control circuit provided on the storage bin must be provided.

Figure 8:
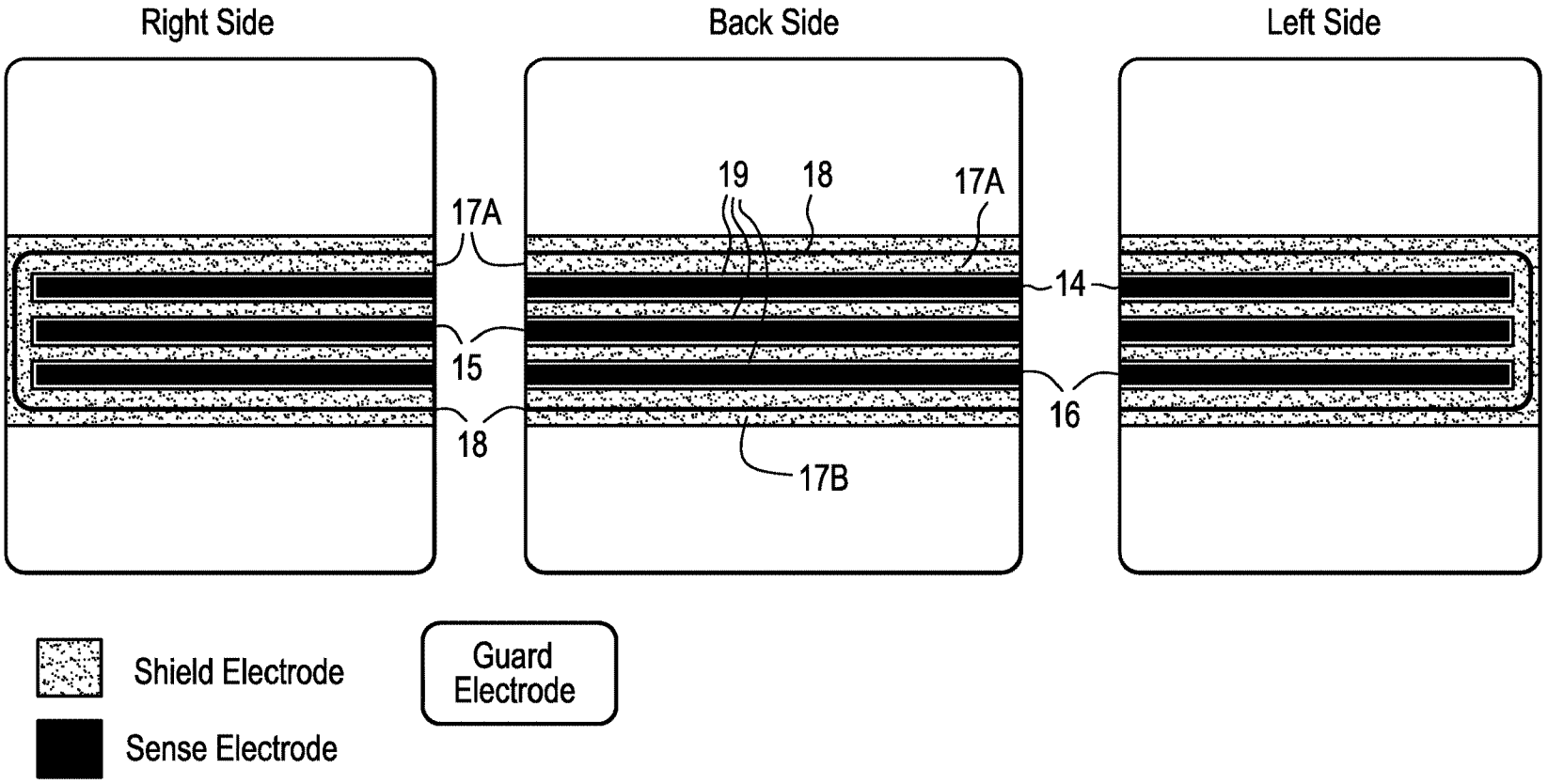
FIG. 8 is a flattened view of walls comprising a second electrode configuration.

FIG. 8 shows a view of each of a right, back and left wall portion of an array of electrodes 11, 12 and 13 that continuously extends around a housing or storage bin.

Figure 9:
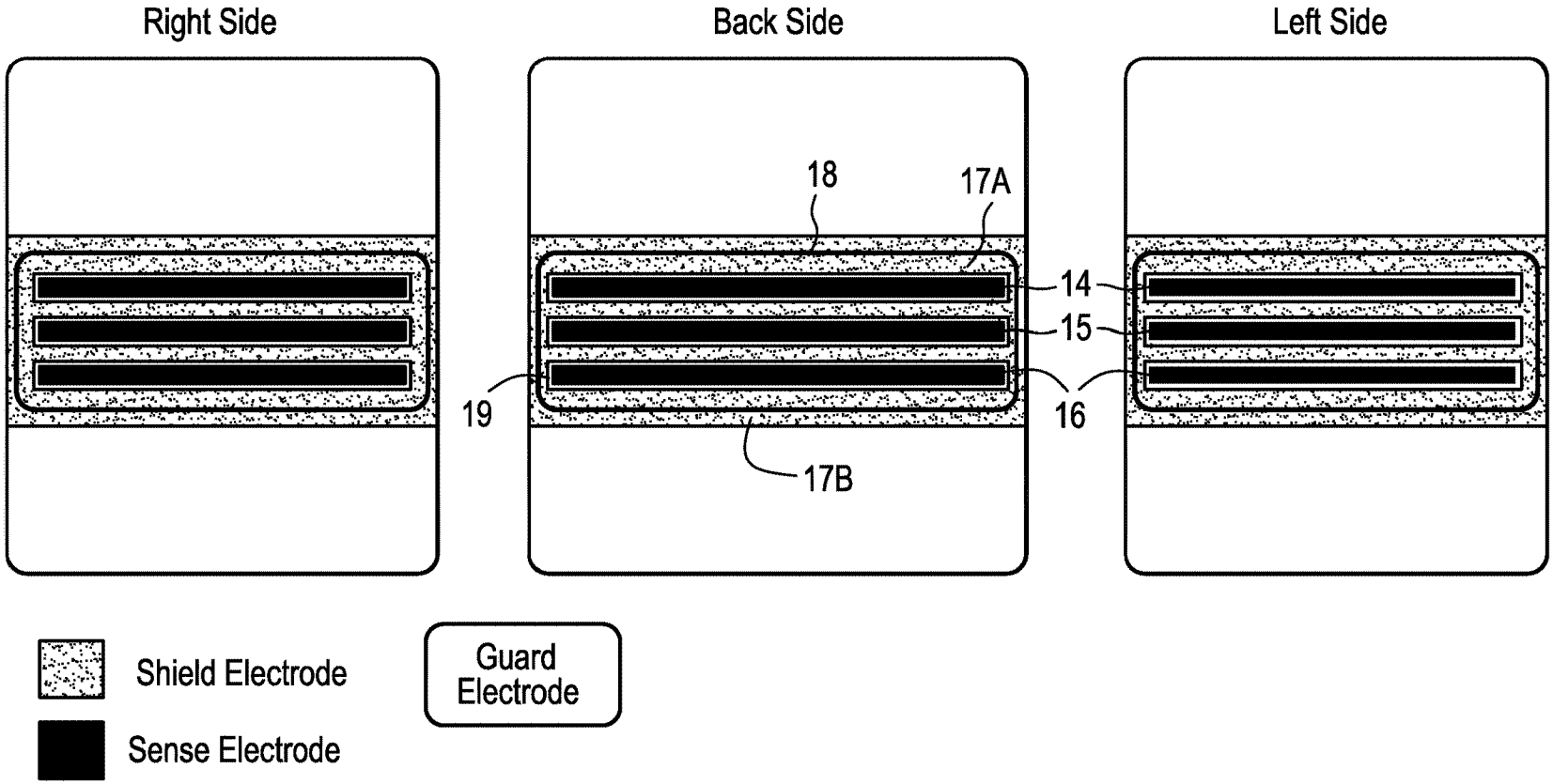
FIG. 9 is a flattened view of walls comprising a second electrode configuration.

In FIG. 8, right, back and left wall sections of an array of three parallel sense electrodes (14, 15 and 16) are shown. This array extends continuously around the walls of a housing or storage bin. This array also includes a shield electrode 17 and a guard electrode 18. In FIG. 9, a first shield electrode area occupies areas immediately around and between the sense electrodes. The first shield electrode area 17A is separated from the sense electrodes 14-16 by gaps 19. The guard electrode 18 extends around the entire perimeter of the first shield electrode area 17A. A second shield electrode area 17B extends around the perimeter of the guard electrode 18. Gaps 19 also separate the first shield electrode area 17A and the second shield electrode area 17B from the guard electrode 18 to provide electrical isolation. In this configuration, the first shield electrode area and the second shield electrode area are electrically connected (i.e., the same buffered signal is applied to both) to form shield electrode 17.

In FIG. 9, separate arrays are shown for use on right, back and left walls of a housing or storage bin. In such configuration, electrodes on one wall are electrically isolated from electrodes on the other walls, so each electrode can be used to provide separate capacitance measurement information to the control circuit. Electrically isolated arrays of electrodes can be positioned on the same wall or on other walls, and may be used to detect ice at the same level to provide redundancy or detect ice levels at different locations (vertically and/or horizontally) on the same wall. First and second electrodes in a first array may detect first and second levels of ice, respectively, while third and fourth electrodes on the same or another wall may detect third and fourth levels of ice in the housing, or provide redundant detection of the first and second levels, for example. The number of electrodes in an array on one wall does not need to be the same as the number of electrodes in an array on any other wall. The array configuration on one wall does not need to be the same as the configuration of other arrays on the same or any other wall. The number of walls on which arrays may extend is dependent on design, and may include only one array on only one wall, one or more arrays on each of a left and right wall, one or more arrays on each of front and back walls, one or more arrays on the housing or storage bin bottom and at least one side wall, or any combination as needed.

One function of the shield electrode 17 is to reduce cross-coupling capacitance between the sense electrodes 14, 15 and 16, as discussed above. Another function of the shield electrode in the ice level sensor of the present invention is to account for frost build-up on the housing or storage walls around the electrodes. When frost forms evenly over an area, the frost that forms over the sense electrodes 14-16 will extend over portions of the shield electrode areas 17A and 17B. The controller compensates for the frost build-up detected by the shield electrode.

When frost build-up is excessive or other conditions occur to cause a significant increase in the capacitance measurement, e.g., multiples of the normal parasitic capacitance of a sense electrode, the effect of the shield electrode may be overcome and an accurate measurement of the ice level in the storage bin is prevented. When the guard electrode 18 around the perimeter of the first shield electrode area 17A detects significantly increased capacitance, the measurements of the sense electrodes 14-16 will be ignored in order to prevent false indications that the storage bin is full. In addition, an error signal or notice of such condition can be issued via a user display/interface or maintenance interface.

The components and operation of each array in FIG. 9 is the same as the single array of electrodes in FIG. 8. The array of electrodes in FIG. 8 provides one set of signals indicating whether ice is detected, while each of the arrays in FIG. 9 provides a separate set of signals. Thus, the control circuit in the embodiment in FIG. 9 receives signals from three times the number sense electrodes in the embodiment in FIG. 8. For a situation in which ice in the storage bin is disposed against one wall at a particular detection level, but not against other walls at that level, as shown in FIG. 3, ice may be detected by one array but not the other arrays in FIG. 9. Under the same ice distribution conditions, the total increase in capacitance detected by a continuous array, like the one in FIG. 8, may or may not be sufficient to indicate that the ice bin is filled to the detection level. The embodiment illustrated in FIG. 9 enables the control circuit to provide more accurate information about the amount of ice in the storage bin 3 and/or a more reliable indication of the ice level, as discussed above.

In the figures in which the thickness of electrodes 11-13 are illustrated, the thickness shown is for purposes of illustration only. The actual thickness of electrodes in an embodiment is dependent on the particular electrode implementation. The electrodes employed in the present invention can comprise metal bars, metal plates, metal tape, metal foil, deposited conductive layers, and/or other forms of conductive elements having different actual thicknesses than those shown in the figures.

Figure 10:
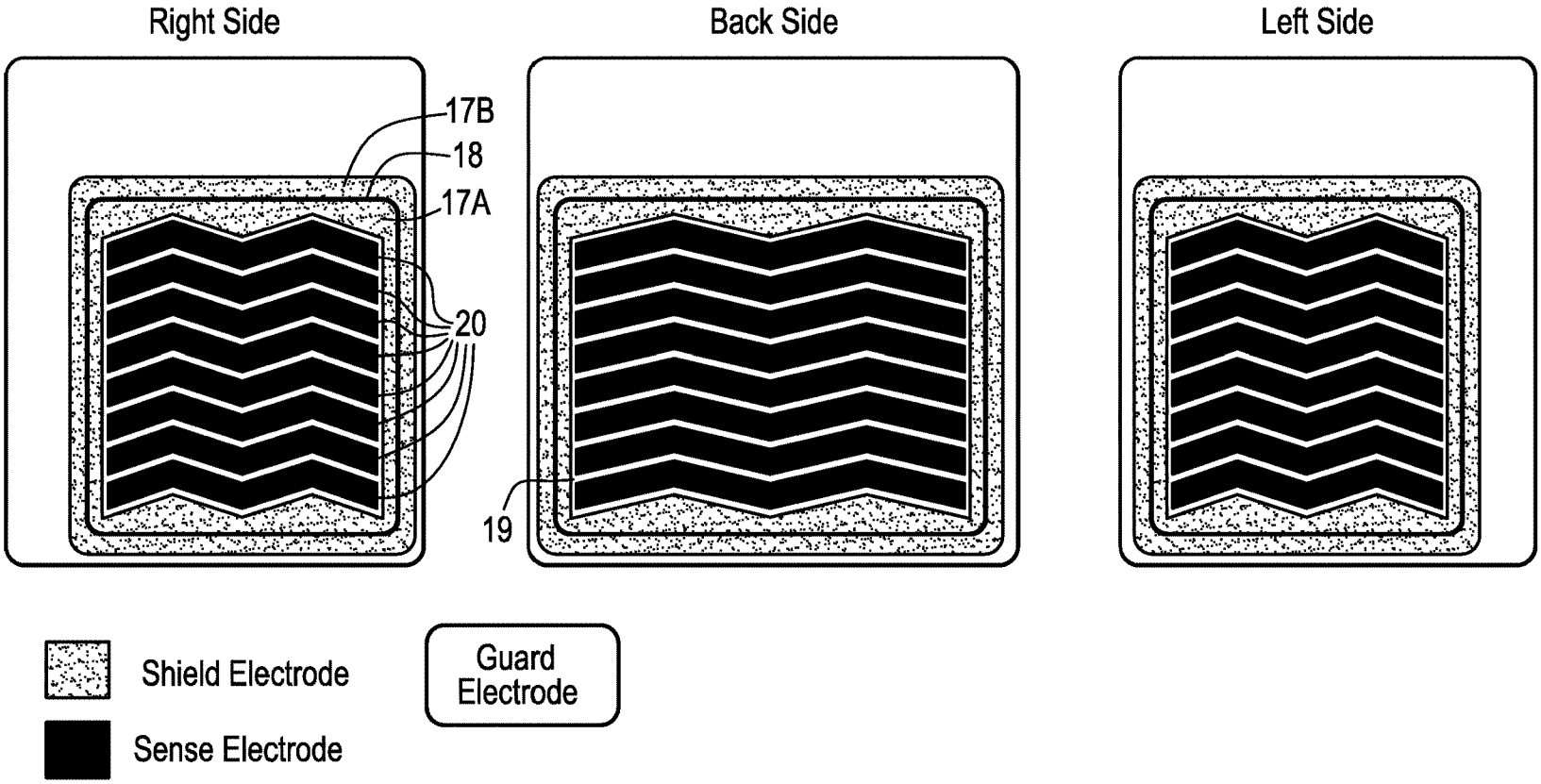
FIG. 10 is a flattened view of walls comprising a second electrode configuration.

In FIG. 10, as in FIG. 9, the sensor comprises three independent arrays of electrodes, one on each of the left, back and right side walls of the housing or storage bin. In FIG. 10, however, the arrays are known as slider arrays comprising at least three sense electrodes 20 each disposed in alignment with and adjacent to one or more other electrodes 20 of similar shape and dimensions. Each electrode is separated from adjacent electrodes by gaps 19. Each sense electrode shown in FIG. 10 is of a zig-zag shape but other similar shapes that achieve the same or similar function to the zig-zag shape (e.g., undulating or wavy shapes) are within the scope of the present invention. The effect of the electrode shape is to allow more than one electrode in the array to detect ice at a given level because the top level is more likely to overlap more than one electrode as a result of their shapes. For example, due to the zig-zag design, the top level of a horizontal layer of ice would cross sections of more than one electrode in the slider array. The controller uses a geometric mean algorithm to determine which electrodes are detecting ice. Thus, as the ice in the storage bin rises, a more accurate determination of the ice level may be possible than with some other configurations. The level of accuracy provided by the sensor can also be increased by increasing the number of electrodes, but such increase requires more connections to the control circuit since each electrode requires a dedicated connection to the control circuit. As in FIGS. 8 and 9, the arrays in FIG. 10 also include shield electrodes and guard electrodes. In any of the above embodiments, a shield electrode may be implemented as a ground electrode.

EXAMPLE

Figure 11:
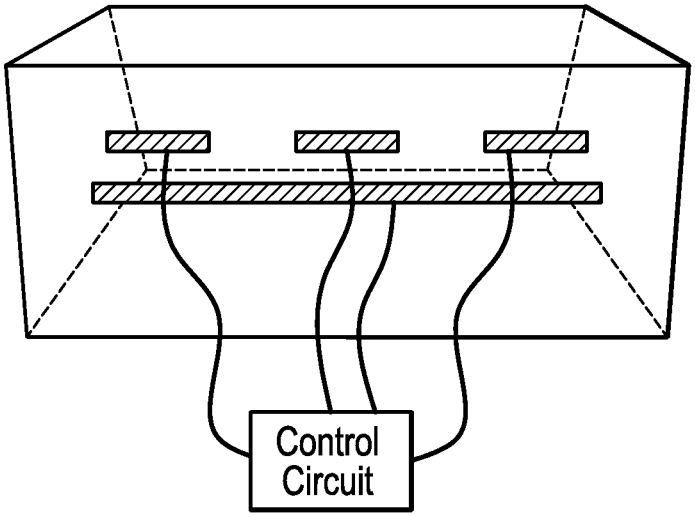
FIG. 11 shows an embodiment of the present invention with electrodes on a plastic storage bin.

FIG. 11 shows an exemplary configuration of the present invention in which three separate sense electrodes are positioned such that the elongated direction of the electrodes was positioned parallel to the bottom of the bin. The electrodes were placed at a threshold level on an outside surface of a wall of a plastic storage bin. A ground electrode or a shield electrode is positioned parallel to and below the three sense electrodes on the same wall of the storage bin. When the storage bin is filled with ice to the threshold level, the control circuit detected the change in capacitance of the three sense electrodes.

Figure 12:
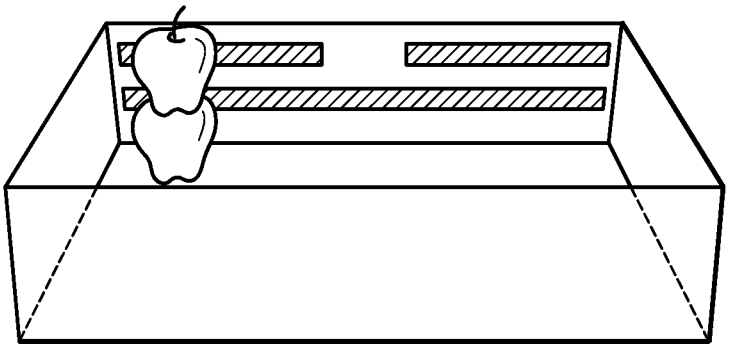
FIG. 12 shows another embodiment of the invention in which apples were detected.

FIG. 12 shows another exemplary configuration of the present invention in which sense electrodes and a ground or shield electrode were attached to an outside surface of a wall of a plastic storage bin. Two apples placed inside the bin were detected by the control circuit. In the embodiments shown in FIGS. 11 and 12, the sense electrodes were comprised of copper tape 9.5 mm wide, the ground electrode was comprised of copper tape 5 mm wide, and the electrical connection to the pSOC was 30 gauge wire or smaller.

Figure 13:
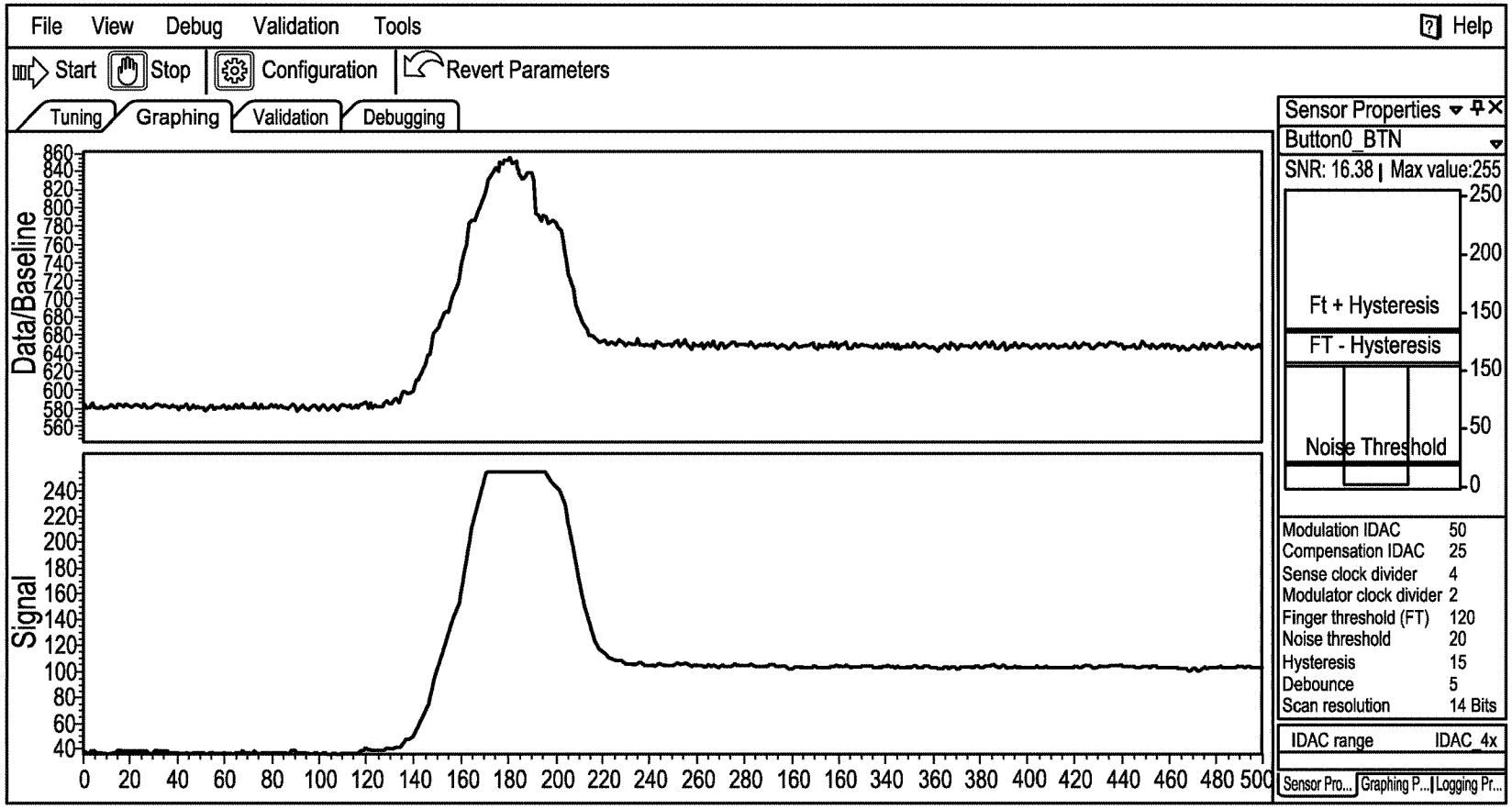
FIG. 13 is a view of capacitive sensor readings taken before and after the apples were placed into the storage bin of FIG. 12.

FIG. 13 shows a graphic illustration of control circuit signals indicating changes in capacitance from before and after the second apple in FIG. 12 was placed into the storage bin. In addition to ice, the sensor can detect other mediums such as water, fruit, vegetables, powders and metal.

Glossary

In the present specification, the definitions of the terms used herein are as follows:

Non-conductive—having a high electrical resistivity as would be known to a person of ordinary skill in the art Horizontal—within 10 degrees of true horizontal, preferably within 5 degrees of horizontal, or within 10 degrees of parallel to the bottom of the housing, preferably within 5 degrees of parallel to the bottom of the housing Zig-Zag—comprises a plurality of alternating odd and even line segments connected together end to end with all odd line segments (i.e., first, third, fifth, etc. starting from one end) parallel to each other in a first direction and all even line segments (i.e., second, fourth, sixth, etc. starting from the one end) parallel to each other in a second direction.

What is claimed is:

1. An appliance, comprising:

a housing configured to receive ice from an ice maker, the housing comprising at least a first wall; and an ice level sensor comprising a control circuit and at least a first electrode array, the first electrode array comprising a first sense electrode, a second sense electrode and a first shield electrode, such that the second sense electrode and the first shield electrode are each oriented parallel to the first sense electrode, with the first shield electrode positioned between the first and second sense electrodes, and the first electrode array positioned one of on an outside surface of the first wall of the housing and on an inside surface of the first wall of the housing, the ice level sensor configured to detect ice in the housing based on a measured capacitance of at least one of the first and second sense electrodes, and the control circuit configured to compensate for frost build-up detected by the first shield electrode.

2. An appliance as recited in claim 1, wherein:

the ice level sensor is configured to detect ice in the housing based on a comparison between a first measured capacitance of the at least one of the first and second sense electrodes and a second measured capacitance of the at least one of the first and second sense electrodes.

3. An appliance as recited in claim 1, wherein:

the ice level sensor is configured to detect ice in the housing based on a comparison of the measured capacitance of the at least one of the first and second sense electrodes to a predetermined value.

4. An appliance as recited in claim 1, wherein:

the ice level sensor is configured to detect ice in the housing based on whether a change in the measured capacitance of the at least one of the first and second sense electrodes exceeds a predetermined value.

5. An appliance as recited in claim 1, wherein:

each sense electrode includes an electrical connection to the control circuit, the control circuit configured to apply a first signal on the electrical connection to each of the sense electrodes, and monitor each electrical connection to the sense electrodes, the measured capacitance of the at least one of the first and second sense electrodes determined based on the monitored electrical connection to the at least one of the first and second sense electrodes.

6. An appliance as recited in claim 5, wherein the first signal is periodically applied, and the control circuit monitors the electrical connection to the at least one of the first and second sense electrodes when the signal is not applied.

7. An appliance as recited in claim 6, wherein the control circuit monitors the electrical connection by monitoring the voltage of the electrical connection.

8. An appliance as recited in claim 1, wherein the first electrode array further comprises a third sense electrode oriented parallel to the first and second sense electrodes, and a ground electrode positioned between the second and the third sense electrodes and oriented parallel to the second and the third sense electrodes.

9. An appliance as recited in claim 8, wherein the housing further comprises at least a second wall and a third wall, and the first electrode array extends across the first wall, the second wall and the third wall of the housing.

10. An appliance as recited in claim 1, wherein the ice level sensor further comprises a second electrode array, the second electrode array comprising at least a third sense electrode.

11. An appliance as recited in claim 5, wherein the first shield electrode includes an electrical connection to the control circuit, and the control circuit is configured to apply a buffered version of the first signal on the electrical connection to the first shield electrode.

12. An appliance as recited in claim 11, wherein at least a first area of the first shield electrode surrounds the first sense electrode without electrically contacting the first sense electrode.

13. An appliance as recited in claim 12, wherein the first electrode array further comprising a third sense electrode, each of the first, second and third sense electrodes extend horizontally from at least a first vertical line for at least a first distance, the second sense electrode positioned between the first sense electrode and the third sense electrode, the first area of the first shield electrode further surrounds the second sense electrode and the third sense electrode and extends through the first distance between the first sense electrode and the second sense electrode and the first distance between the second sense electrode and the third sense electrode, and the first area of the first shield electrode is electrically spaced from each of the first, second and third sense electrodes.

14. An appliance as recited in claim 1, wherein the ice level sensor comprises a plurality of electrode arrays, the arrays positioned on any of a front wall, a left side wall, a right side wall, a back wall and/or a bottom of the housing.

15. An appliance as recited in claim 11, wherein the first electrode array further comprises at least a first guard electrode, the first guard electrode extending along a perimeter around a first area of the first shield electrode, the control circuit configured to measure the capacitance of the first guard electrode, and the control circuit disables an indication of ice detection when a change of capacitance of the first guard electrode exceeds a threshold.

16. An appliance as recited in claim 15, wherein the first shield electrode comprises a second area extending along a perimeter around the first guard electrode, and the second area of the first shield electrode is electrically connected to the first area of the first shield electrode.

17. An appliance as recited in claim 11, wherein the first electrode array comprises a plurality of sense electrodes each having a first zig-zag shape, the first sense electrode of the plurality of sense electrodes extending horizontally from a first vertical line to a second vertical line, the other sense electrodes of the plurality of sense electrodes extending horizontally and parallel to the first sense electrode and to one another from the first vertical line, the plurality of sense electrodes spaced apart and electrically isolated from each other, a first area of the first shield electrode extending around but not between the plurality of sense electrodes.

18. An appliance as recited in claim 1, wherein the ice level sensor provides an interlock to stop the ice maker from depositing ice into the housing.

19. A method of detecting ice in a housing using an ice level sensor that comprises a control circuit and at least a first electrode array, the first electrode array comprises a first sense electrode, a second sense electrode and a first shield electrode, with the second sense electrode and the first shield electrode each oriented parallel to the first sense electrode, and the first shield electrode is positioned between the first and second sense electrodes, the method comprising:

positioning the first electrode array on a wall of an ice storage housing, such that the first electrode array is positioned one of on an outside surface of the wall of the housing and on an inside surface of the wall of the housing, detecting ice in the housing based on a measured capacitance of at least one of the first and second sense electrodes, and the control circuit compensating for frost build-up detected by the first shield electrode.

20. An appliance as recited in claim 1, wherein the first sense electrode, the second sense electrode and the first shield electrode are comprised of copper.

* * * * *